United States Patent [19]

Dorsett

[11] Patent Number: 5,035,136

[45] Date of Patent: Jul. 30, 1991

[54] BENDING APPARATUS FOR BENDING A MARGIN FLANGE

[75] Inventor: Michael W. Dorsett, Weybridge, Great Britain

[73] Assignee: AB Volvo, Gothenburg, Sweden

[21] Appl. No.: 566,402

[22] PCT Filed: Mar. 7, 1989

[86] PCT No.: PCT/SE89/00105

§ 371 Date: Aug. 15, 1990

§ 102(e) Date: Aug. 15, 1990

[87] PCT Pub. No.: WO89/09101

PCT Pub. Date: Oct. 5, 1989

[30] Foreign Application Priority Data

Mar. 21, 1988 [SE] Sweden ..... 8801036

[51] Int. Cl.[5] ..... B21D 5/00; B21D 39/02

[52] U.S. Cl. ..... 72/450; 72/451; 100/280; 29/243.58

[58] Field of Search ..... 72/381, 380, 323, 450, 72/451, 407; 29/243.58; 100/280

[56] References Cited

U.S. PATENT DOCUMENTS 4,346,579 8/1982 Takatsu ..... 72/450
4,706,489 11/1987 Dacey, Jr. ..... 72/450

FOREIGN PATENT DOCUMENTS 1155414 10/1963 Fed. Rep. of Germany .
1198313 8/1965 Fed. Rep. of Germany .
958671 5/1964 United Kingdom .
958672 5/1964 United Kingdom .
1075663 7/1967 United Kingdom .

*Primary Examiner*—David Jones
*Attorney, Agent, or Firm*—Young & Thompson

[57] ABSTRACT

The invention relates to an apparatus for bending a flange against a workpiece (3). A preliminary bending tool (5) on a first tool holder (7) is carried by a linkage mechanism (8–13) for movement in relation to a stand (1). A bend finishing tool (6) on a second tool holder (14) is carried by a parallelogram linkage mechanism (15–20) for movement in relation to the stand (1). The first linkage mechanism (8–13) forms a parallelogram having a line between the axes (10,11) of the links extending perpendicularly to a line between the axes (17,18) of the second linkage mechanism (15–20). One single drive member (21) is connected to the parallelogram linkage mechanism (15–20) to drive the second tool holder (14). A drive link (28) is connected between the parallelogram linkage mechanism (15–20) and the first tool holder (7) to drive this.

3 Claims, 2 Drawing Sheets

BENDING APPARATUS FOR BENDING A MARGIN FLANGE

The present invention relates to apparatus for bending a margin flange, which projects at an angle to a workpiece surface against said surface, said apparatus including a preliminary bending tool which is mounted on a first tool holder carried by a linkage mechanism for movement in relation to a stand which is stationary relative to a support surface on which the workpiece is placed, and further including a hand finishing or clinching tool mounted on a second tool holder which is carried by a parallelogram linkage for movement in relation to the stand, and also a drive arrangement which is connected drivingly to said two tool holders.

Apparatus of this kind are previously known and are used for bending an upstanding margin flange on one plate or panel around a margin of another plate or panel, to provide therewith a clinching or hemming joint between the two plates or panels. Such operations are common for instance in the vehicle manufacture industry, in the production of different vehicle body parts.

The object of the present invention is to provide an improved apparatus of the aforesaid kind. This object is achieved in that the linkage mechanism between the first tool holder and the stand is a parallelogram linkage mechanism which is arranged such that an imaginary connecting line between the stand-carried pivot axes of the links of said linkage mechanism extends substantially at right angles to an imaginary connecting line between the stand-carried pivot axes of the links of the parallelogram linkage of the second tool holder; and in that the drive arrangement includes a single drive member which is connected between the stand and a link in the parallel-ogram linkage of the second tool holder such as to drive said second tool holder, and a drive link which is connected between the parallelogram linkage of the second tool holder and the first tool holder, such as to drive said first tool holder.

The invention will now be described in more detail with reference to the accompanying drawings, in which FIG. 1 is a somewhat schematic side view of bending apparatus constructed in accordance with the invention:

Figure 1:
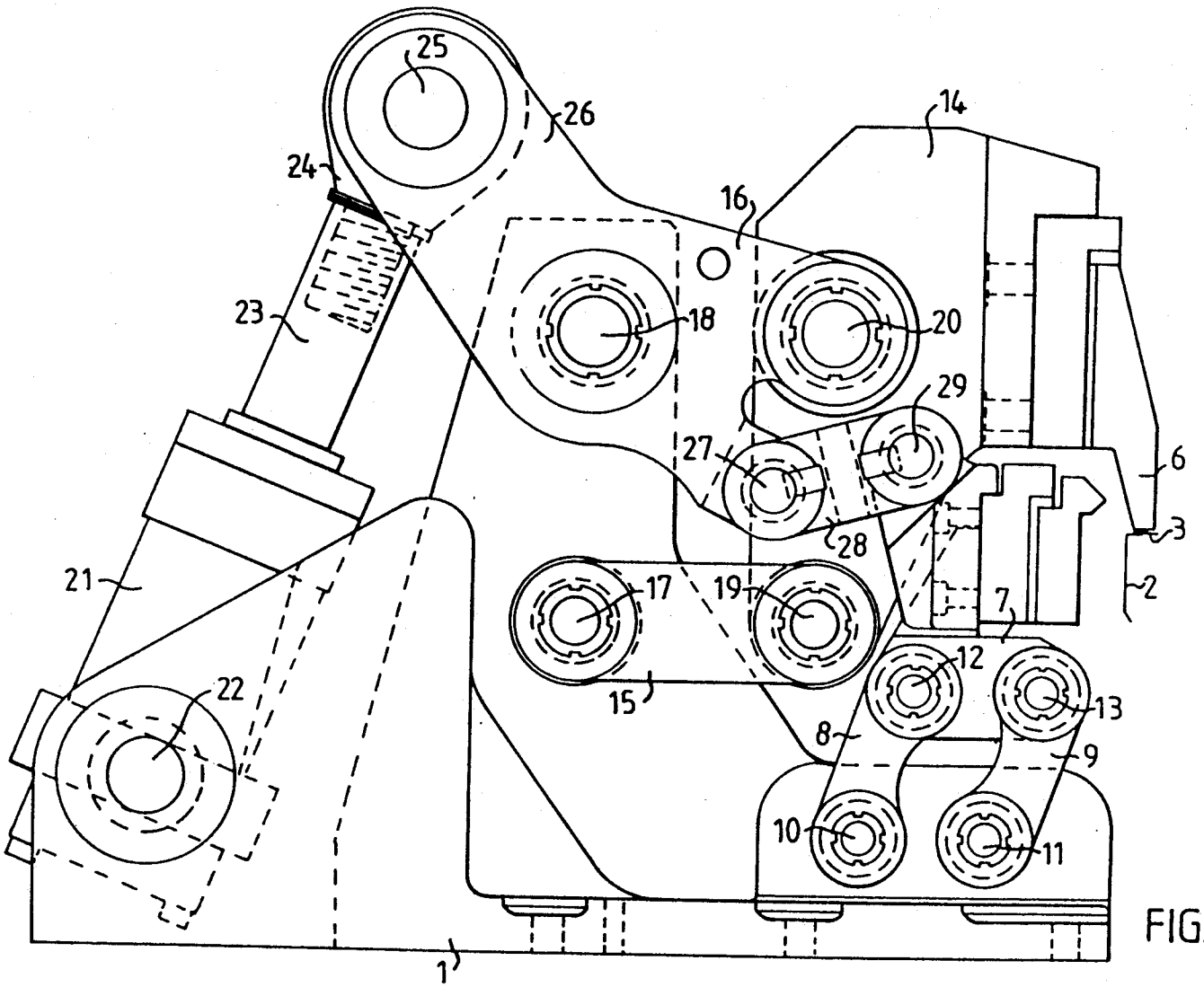
Figure 2:
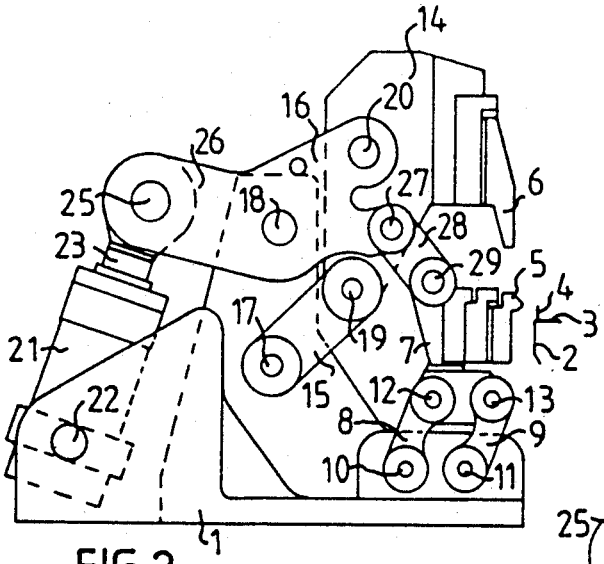
FIG. 2 is a schematic side view of the apparatus of FIG. 1 and illustrates the apparatus components in their respective starting positions. prior to commencing a working sequence.
Figure 3:
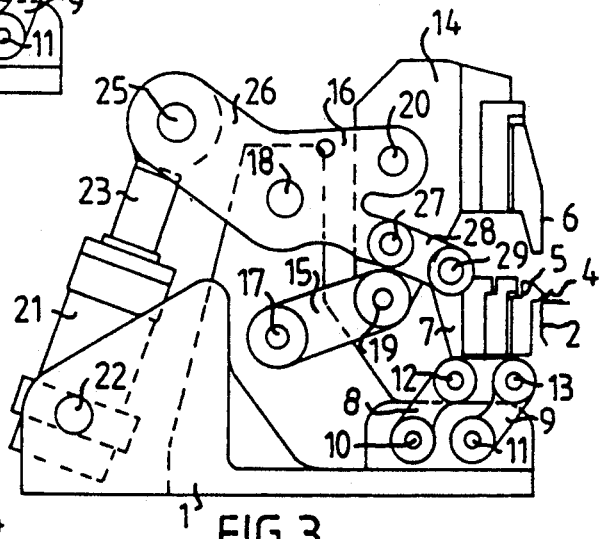
FIG. 3 is a schematic side view of the apparatus of FIG. 1 and illustrates the apparatus components in their respective preliminary bending or pre-form positions, during a working sequence.
Figure 4:
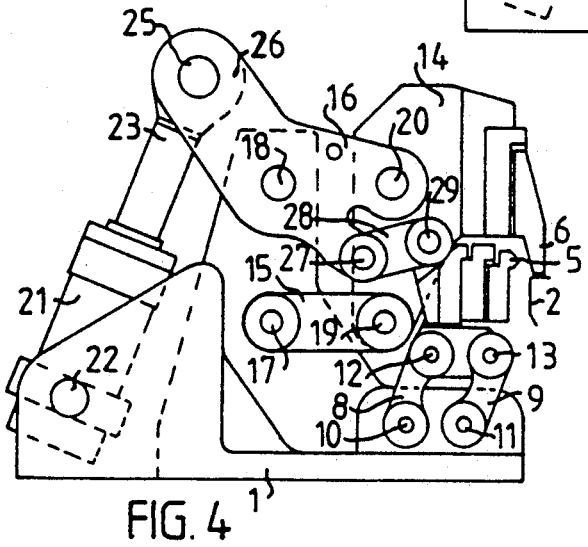
FIG. 4 is a schematic side view of the apparatus of FIG. 1 and illustrates the apparatus components in their respective bend finishing or clinching position.

The illustrated bending apparatus comprises a stand 1 which is supported on a support surface 2, of which only a small part is shown and which supports a workpiece 3. The illustrated workpiece 3 is a sheet metal rail having an upstanding margin flange 4, which in the FIG. 2 illustration extends upwards from the major part of the workpiece, and which in FIG. 3 is shown in a preliminarily bent position and in FIG. 4 is shown in its fully bent or clinching position. The workpiece 3 may be elongated at right angles to the plane of the drawing and may therewith be straight or curved.

Bending of the margin flange 4 from the starting position illustrated in FIG. 2 to the pre-bend position illustrated in FIG. 3 is effected with the aid of a preliminarily bending or pre-bend tool 5, whereas continued bending of the margin flange 4, from the pre-bend position shown in FIG. 3 to the clinching position shown in FIG. 4 is effected with the aid of a bend finishing or clinching tool 6. When viewed at right angles to the plane of the drawing, both the pre-bend tool 5 and the clinching tool 6 have a shape which corresponds to the shape of the workpiece 3, so that the tools are able to co-act with the margin flange 4 over the whole of its length.

The pre-bend tool 5 is mounted on a first tool holder 7, which is connected to the stand 4 by means of two links 8 and 9. The links 8 and 9 are of mutually equal length and are journalled on respective journal pins 10 and 11 on the stand 1, and on respective journal pins 12 and 13 on the tool holder 7. The spacing between the journal pins 10 and 11 is equal to the spacing between the journal pins 12 and 13, so as to form a parallelogram linkage mechanism which carries the tool holder 7 in relation to the stand 1.

The clinching tool 6 is mounted on a second tool holder 14, which is connected to the stand 1 by means of two links 15 and 16. The links 15 and 16 are journalled on respective journal pins 17 and 18 on the stand 1, and on respective journal pins 19 and 20 on the tool holder 14. The spacing between the journal pins 17 and 18 is equal to the spacing between the journal pins 19 and 20, and the links 15 and 16 are also of mutually equal lengths, so as to form a parallelogram linkage mechanism which carries the tool holder 14 in relation to the stand 1. An imaginary connecting line between the geometric axes of journal pins 17 and 18 will therewith be substantially perpendicular to an imaginary connecting line between the geometric axes of journal pins 10 and 11, which means that the parallelogram linkage mechanism which carries the tool holder 14 is substantially perpendicular to the parallelogram linkage mechanism which carries the tool holder 7.

The stand also carries a drive arrangement by means of which the pre-bend tool 5 and the clinching tool 6 are moved so as to bend-in the margin flange 4. This drive arrangement includes a pressure-medium operated piston-cylinder device 21, which is pivotally mounted on journal pins 22 fixedly mounted on the stand 1. The piston-cylinder device 21 includes a piston rod 23 which is provided with an end piece 24. The end piece 24 is connected by a journal pin 25 to an arm 26, which forms an extension of the link 16 on the other side of the journal pin 18. Consequently, the link 16 can be swung around the journal pin 18, by displacing the piston rod 23 axially in relation to the cylinder 21, therewith to move the tool holder 14 and the clinching tool 6 towards or away from the workpiece 3.

In the vicinity of the journal pin 20 the link 16 is also provided with a journal pin 27 on which one end of a drive link 28 is journalled. The other end of the drive link 28 is journalled on a journal pin 29 on the tool holder 17 carrying the pre-bend tool 5. Consequently, the drive link 28 will move the tool holder 7 and the pre-bend tool 5 in response to pivotal movement of the link 16 about the journal pin 18, this movement being controlled by the parallelogram linkage mechanism 8–13 in a manner described in more detail here below.

A working sequence for bending the margin flange 4 against the workpiece 3 will now be described with reference to FIGS. 2-4. FIG. 2 illustrates the starting position of the apparatus components, in which both the pre-bend tool 5 and the clinching tool 6 are spaced from the workpiece 3 and the margin flange 4 located thereon. In this stage of the sequence, the piston rod 23 is fully withdrawn in the cylinder 21, and hence the link 16 is swung anti-clockwise to a maximum (seen on the drawing) about the journal pin 18 on the stand 1. The tool holder 14 and the clinching tool 6 have therewith been raised to an uplifted position, with the aid of the parallelogram linkage mechanism 15-20, and at the same time the drive link 28 has moved the tool holder 7 and the pre-bend tool 5 to the left, as seen in the drawing. Thus, in this starting mode of the apparatus, it is possible to place the workpiece 3 onto the workpiece support surface 2, without obstruction by the pre-bend tool 5 or the clinching tool 6 or by any other parts of the apparatus.

The link 16 is pivoted about the journal pin 18, by extending the piston rod 23 from the cylinder 21, whereby the parallelogram linkage mechanism 15-20 moves the tool holder 14 and the clinching tool 6 in a direction towards the workpiece 3. During this movement, the drive link 28 will also move the tool holder 7 and the pre-bend tool 5 towards the workpiece 3, this movement being controlled by the parallelogram linkage mechanism 8-13. In the position of the apparatus components illustrated in FIG. 3, the drive link 28 has moved the tool holder 7 to the maximum possible extent towards the workpiece 3, and the pre-bend tool 5 has been moved into engagement with the margin flange 4 and has preliminarily bent the flange. The link 16 between the journal pins 18 and 27 and the drive link 28 form a toggle link mechanism, which in the position illustrated in FIG. 3 is fully extended, i.e. the journal pins 18, 27 and 29 are located on a straight line. This means that pivotal movement of the link 16 about the journal pins 18 from the position shown in FIG. 3 will cause the tool holder 7 and the pre-bend tool 5 to be moved away from the workpiece 3, irrespective of the pivoting direction. In the position of the apparatus components illustrated in FIG. 3, the clinching tool 6 and its tool holder 14 have been moved towards the workpiece 3, although the clinching tool 6 is still spaced from the margin flange 4.

Further extension of the piston rod 23 from the cylinder 21, from the position illustrated in FIG. 3 to the position illustrated in FIG. 4, will cause the link 16 to be swung further in a clock-wise direction, about the journal pin 18. This will cause the drive link 28 to move the pre-bend tool 5 and the tool holder 7 away from the workpiece 3, this movement being controlled by the parallelogram linkage mechanism 8-13. At the same time, the tool holder 14 and the clinching tool 6 will be moved, with the aid of the parallelogram linkage mechanism 15-20, to a position in which the clinching tool 6 has bent the margin flange 5 fully against the workpiece 3, therewith clinching said workpiece as illustrated in FIG. 4. The bending cycle is therewith completed, and the apparatus components can be returned to their respective starting positions, illustrated in FIG. 3, by withdrawing the piston rod 23 into the cylinder 21, whereafter a new working sequence can be commenced.

The invention is not restricted to the aforedescribed exemplifying embodiment, since modifications can be made thereto within the scope of the following claims.

I claim:

1. Apparatus for bending a margin flange (4), which projects at an angle to a surface on a workpiece (3) against said surface, said apparatus including a preliminary bending tool (5), which is mounted on a first tool holder (7) carried by a linkage mechanism (8-13) for movement in relation to a stand (1) which is stationary in relation to a support surface (2) on which the workpiece (3) is placed, and further including a bend finishing tool (6) which is mounted on a second tool holder (14) carried by a first parallelogram linkage mechanism (15-20) for movement in relation to the stand (1), said parallelogram linkage mechanism comprising first links (15, 16) having each at one end a pivot axis (17, 18) carried by the stand (1) and at the other end a pivot axis (19, 20) carried by the second tool holder (14), the distance between the stand-carried pivot axes (17, 18) being equal to the distance between the pivot axes (19, 20) carried by the second tool holder (14) and the distance between the pivot axes (17, 19) on one link (15) being equal to the distance between the pivot axes (18, 20) on the other link (16), and also a drive arrangement (21-24) for driving the two tool holders (7, 14), said drive arrangement including a single drive member (21) for driving the second tool holder (14), and a drive link (28) which is connected between the first parallelogram linkage mechanism (15-20) of the second tool holder (14) and the first tool holder (7) for driving said first tool holder, characterized in that the linkage mechanism between the first tool holder (7) and the stand (1) is a second parallelogram linkage mechanism (8-13) comprising second links (8, 9) having each at one end a pivot axis (10, 11) carried by the stand (1) and at the other end a pivot axis (12, 13) carried by the first tool holder (7) and wherein the distance between the stand-carried pivot axes (10 11,) is equal to the distance between the pivot axes (12, 13) carried by the first tool holder (7) and the distance between the pivot axes (10, 12) on one of said second links (8) is equal to the distance between the pivot axes (11, 13) on the other of said second links (9), said first and second parallelogram linkage mechanisms being arranged such that an imaginary connecting line between the stand-carried pivot axes (10, 11) of the second links extend substantially perpendicular to an imaginary connecting line between the stand-carried pivot axes (17, 18) of the first parallelogram linkage mechanism (15-20) of the second tool holder (14), and in that the single drive member (21) is connected between the stand (1) and a first link (16) in the first parallelogram linkage mechanism (15-20) of the second tool holder (14).

2. Apparatus according to claim 1, characterized in that the drive link (28) in pivotable connection with a portion of one of said first links (16) of the first parallelogram linkage mechanism (15-20) of the second tool holder (14) forms a toggle link mechanism, said toggle link mechanism having fully extended and withdrawn positions, when in its fully extended position the first tool holder (7) is located in a preliminary bending position with the preliminary bending tool (5) in engagement with the margin flange (4) of the workpiece (3).

3. Apparatus according to claim 1, characterized in that the drive member (21) is connected between the stand (1) and an extension (26) of one of the first links (16) on a side of the stand-carried pivot axis (18) opposite the pivot axis (20) carried by the second tool (14).

* * * * *